US005735328A

United States Patent [19]

Salhoff et al.

[11] Patent Number: 5,735,328

[45] Date of Patent: Apr. 7, 1998

[54] WINDOW SHADE SYSTEM WITH MULTIPLE, SEQUENTIALLY CONNECTED WINDOW SHADING ELEMENTS

[76] Inventors: LaVerne W. Salhoff, P.O. Box 85505; Gregory D. Salhoff, P.O. Box 5505, both of Las Vegas, Nev. 89185-0505

[21] Appl. No.: 731,646

[22] Filed: Oct. 17, 1996

[51] Int. Cl.[6] ..... A47H 1/00

[52] U.S. Cl. ..... 160/25; 160/120; 160/241

[58] Field of Search ..... 160/309, 25, 31, 160/120, 122, 85, 86, 239, 240, 241, 270, 271, 310, 1, 2, 5, 7, 9

[56] References Cited

U.S. PATENT DOCUMENTS

| | | | |
|---|---|---|---|
| 351,502 | 10/1886 | Dougherty | 160/241 |
| 1,263,329 | 4/1918 | Lark | 160/241 X |
| 2,271,099 | 1/1942 | Schur | 160/241 |
| 2,404,257 | 7/1946 | Thomas | 160/241 X |
| 3,186,473 | 6/1965 | Myers et al. | 160/241 X |
| 3,236,290 | 2/1966 | Lueder | 160/241 |
| 3,308,872 | 3/1967 | Smith | 160/120 |
| 4,285,577 | 8/1981 | Schuler | 350/403 |
| 4,290,473 | 9/1981 | Pierson et al. | 160/120 |
| 4,382,436 | 5/1983 | Hager | 160/241 X |
| 4,579,426 | 4/1986 | Onufry | 350/407 |
| 4,766,941 | 8/1988 | Sloop et al. | 160/241 |
| 4,813,198 | 3/1989 | Johnston et al. | 160/85 X |
| 5,033,829 | 7/1991 | Faroughy | 350/396 |
| 5,164,856 | 11/1992 | Zhang et al. | 359/489 |
| 5,344,206 | 9/1994 | Middleton | 160/271 X |

*Primary Examiner*—David M. Purol
*Attorney, Agent, or Firm*—Joseph N. Breaux

[57] ABSTRACT

A window shade system including a flexible shading member having multiple, sequentially connected shading elements, at least one of the shading elements having a tint factor of between five and fifty percent inclusive; at least one of the shading elements having a tint factor between fifty-one and ninety-five percent inclusive; and first and second reel assemblies, each reel assembly being attachable to a structure adjacent a window, the first reel assembly having a first rotatable reel shaft secured to a first end of the shading member, the second reel assembly having a second rotatable reel shaft secured to a second end of the shading member, the first and second reel assemblies working in a complimentary fashion such that when one reel shaft is rotating in a take-off direction the other reel shaft is rotating in a take-up direction. The flexible shading member is preferably constructed from a clear plastic film and preferably includes a cut-out section positionable across the window opening to allow access through the window opening if desired without requiring removal of the window shade system.

7 Claims, 4 Drawing Sheets

10
102
100
104
106

10
110
16
70
70
18
12
100
112

WINDOW SHADE SYSTEM WITH MULTIPLE, SEQUENTIALLY CONNECTED WINDOW SHADING ELEMENTS

TECHNICAL FIELD

The present invention relates to window shading devices and more particularly to a window shade system including an elongated, flexible shading member having multiple shading elements formed sequentially thereon that is attached between two reel mechanisms. The reel mechanisms allow a user to position a desired shading element across the window opening to provide a variety of shading effects by activation of the reel mechanisms in a complementary, take-up/feed manner.

BACKGROUND OF THE INVENTION

Windows provide light into a room and viewing access to the outside world to those confined within a room. Although the additional light and viewing access are generally welcome, there are often times when the occupant of a room desires to decrease the light entering the room, or totally eliminate light entering the room such as when sleeping or to block viewing into the room through the window when conducting private activities. It would be a benefit, therefore, to have a window shade system that allowed an individual inside a room to select a desired degree of window shading from a slight tinting to a complete blacking out of light through the window.

Because window shading elements can prevent the flow of air through the window, it would be a further benefit to have a window shade system that provided no shading element or barrier between the room and the window when desired without requiring removal of the window shade system.

SUMMARY OF THE INVENTION

It is thus an object of the invention to provide a window shade system that includes a window shading member with multiple, sequentially connected window shading elements.

It is a further object of the invention to provide a window shade system with multiple, sequentially connected window shading elements including an element consisting of a cut-out portion such that no shading element or barrier is provided between the room and the window when desired.

It is a still further object of the invention to provide a window shade system that accomplishes both of the above objects in combination.

Accordingly, a window shade system is provided. The window shade system comprises a flexible shading member having multiple, sequentially connected shading elements, at least one of the shading elements having a tint factor of between five and fifty percent inclusive, at least one of the shading elements having a tint factor between fifty-one and ninety-five percent inclusive; and first and second reel assemblies, each reel assembly being attachable to a structure adjacent a window, the first reel assembly having a first rotatable reel shaft secured to a first end of the shading member, the second reel assembly having a second rotatable reel shaft secured to a second end of the shading member, the first and second reel assemblies working in a complimentary fashion such that when one reel shaft is rotating in a take-off direction the other reel shaft is rotating in a take-up direction. The term "tint factor" is used herein to mean a designation for the percent of light prevented from passing through the shading element by the tint deposited thereon. The term "take-off" is used herein to mean material wound on the reel shaft is being removed from the winding reel. The term "take-up" is used herein to mean material is being wound onto the reel shaft.

The flexible shading member is preferably constructed from a clear plastic film material, such as Mylar or nylon, and preferably includes a cut-out section positionable across the window opening to allow access through the window opening if desired without requiring removal of the window shade system. The flexible shading member also preferably includes at least one black-out shading element having an opaque layer having a tint factor of substantially one-hundred percent that blocks transmission of light through the section. When a black-out shading element is included, it is preferred to provide a reflective layer on the outwardly directed surface thereof to provide reduced heat transfer into the room.

The reel assemblies are preferably each enclosed within reel housing. Each reel housing preferably is provided with a pair of spaced trackways that extend from an opening thereof and that guide the side edges of the flexible shading member along a substantially straight path. When the above described reel housings are used, it is also preferred to include a pair of adjustment segments that are connectable between the corresponding trackways of a pair of reel housings so that a pair of continuous trackways are provided between the first and second reel shafts of the first and second reel assemblies. In addition, if desired, the window shade system can be provided with various accessory items. For instance, a motor drive can be provided for driving one or more of the reel shafts. When a motor drive is utilized the motor drive can be activated by a stationary switch provided on a portion of the window shade system or by a remote control provided for that purpose. Additionally, if desired, an ambient light sensing circuit can be included. The light sensing circuit can include a user set light level input mechanism, such as a variable resistor, and a control circuit, such as a comparator, that controls the motor drive in a manner such that the shading member is moved to a position where the desired lighting conditions are achieved within the room.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
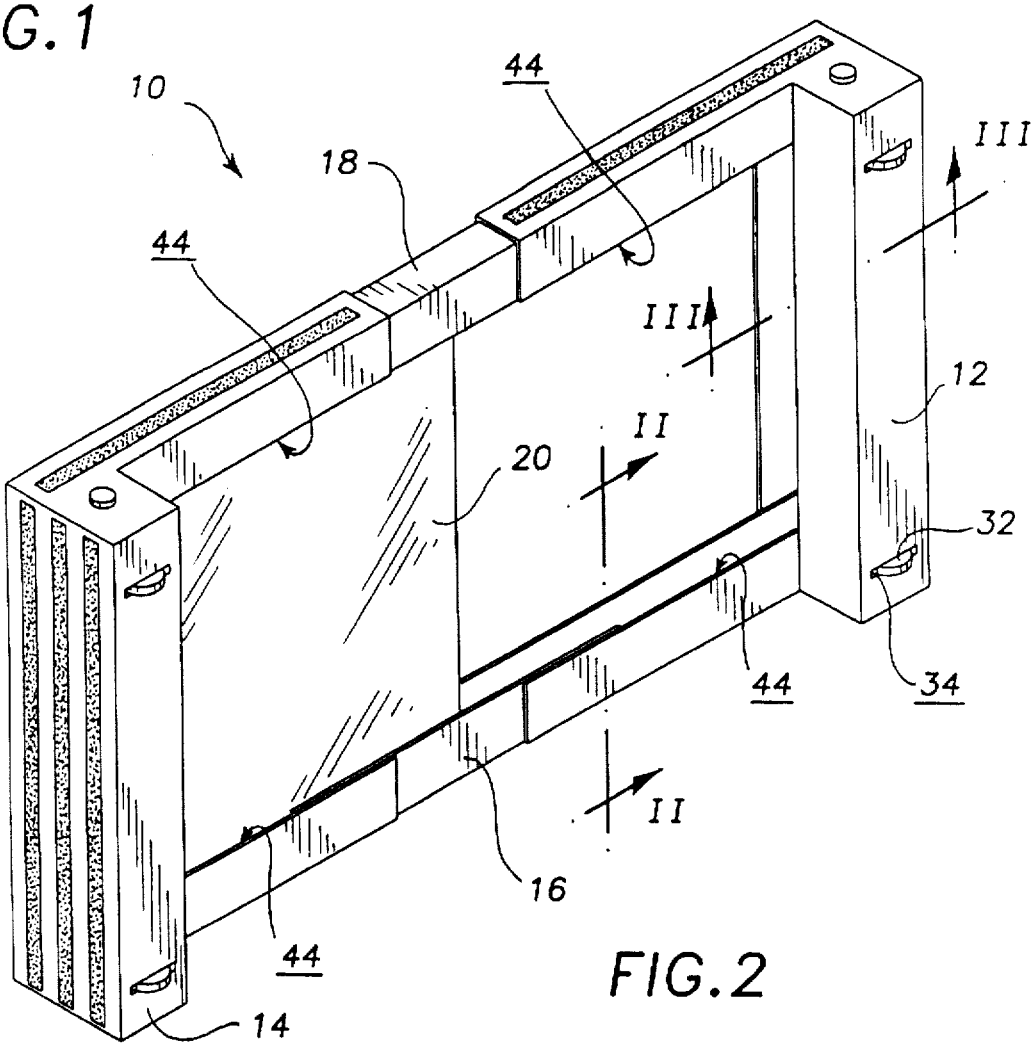
FIG. 1 is a perspective view of the screening assembly of the window shade system of the present invention showing the first reel housing, the second reel housing, the first and second adjustment segments positioned between the reel housings, and a segment of the elongated, flexible shading member partially showing the transparent element and the open section element.

FIG. 1 shows a first exemplary embodiment of the window shade system of the present invention generally designated by the numeral 10. Shade system 10 includes a first reel housing 12; a second reel housing 14; first and second adjustment segments 16,18; and an elongated, flexible shading member 20. First and second reel housings 12,14 are identical and are each molded from plastic.

Figure 2:
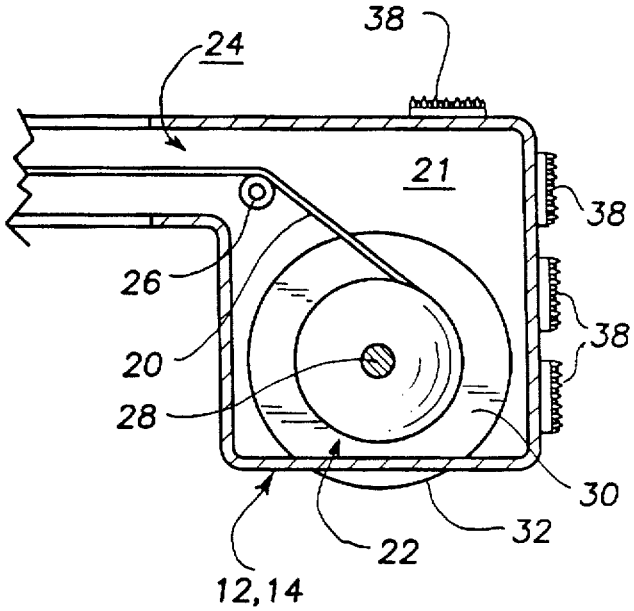
FIG. 2 is a sectional view of the second reel housing showing the reel compartment, the reel shaft, a section of the flexible shading member wound onto the reel shaft, the rotatable shading element guide, and four of the six hook and pile attachment strips positioned on the exterior of each housing.

With reference to FIG. 2, each reel housing 12,14 includes a reel compartment 21 having a housing opening 24 for providing a path for shading member 20 to pass into reel compartment 21. Each reel compartment 21 holds a reel assembly 22 and a rotatable shading element guide 26. Each reel assembly 22 includes a rotatably mounted reel shaft 28 having a pair of spaced, coaxially mounted thumb wheels 30 (only one shown) at either end thereof. Thumb wheels 30 are spaced a distance at least equal to the width "A" (FIG. 5) of shading member 20. A portion 32 of each thumb wheel 30 extends through a thumb wheel opening 34 (shown in FIG. 1) to allow a user to rotate reel shaft 28 in either a take-up or take-off direction.

One end of shading member 20 is positioned through housing opening 24 over rotatable shading element guide 26 and secured to reel shaft 28. Shading member 20 is then wound onto or off of reel shaft 28 by manipulation of thumb wheels 30 in the required direction. Also shown in the figure are four of the six sections of the hook and pile attachment sections 38 that are positioned on an exterior surface of each housing 12,14. Sections 38 are used to secure each housing 12,14 in place during installation.

Figure 3:
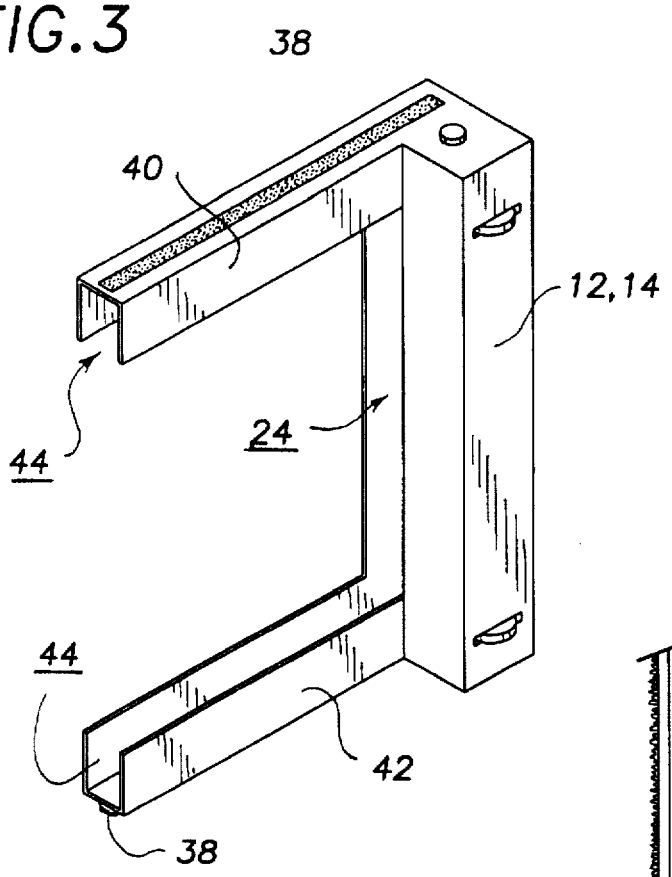
FIG. 3 is a perspective view of one of the reel housings in isolation showing the housing opening and the upper and lower trackways.

FIG. 3 shows a housing 12,14 in isolation. Each housing 12,14 has a pair of spaced upper and lower trackways 40,42. In this embodiment, each trackway 40,42 is integrally molded at either end of housing opening 24 and includes a channel 44 for guiding the edges of shading member 20 between the two housing openings 24. Also shown are the additional two of the six sections of the hook and pile attachment sections 38 positioned on an exterior surface of each housing 12,14.

Figure 4:
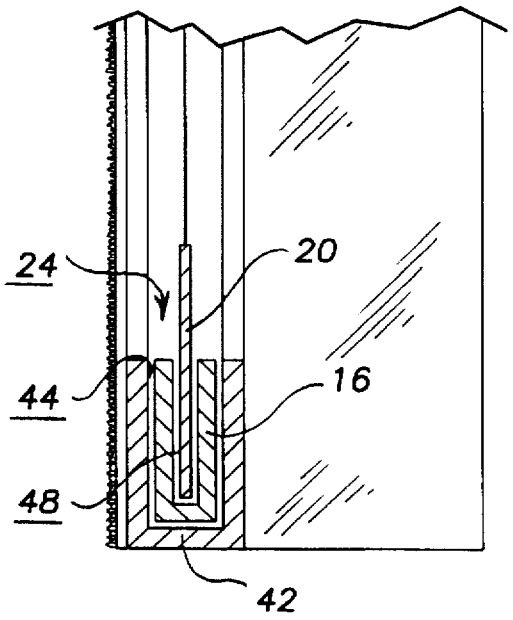
FIG. 4 is a sectional view across the bottom trackway of the second reel housing showing sectional views of the bottom trackway, the second adjustment segment, and the cut-out section element of the flexible shading member; and plan views of the housing opening and the sidewall of the reel housing.

With reference back to FIG. 1, each channel 44 is sized to receive an extension member 16,18. Extension members 16,18 are identical and are each lengths of plastic channel sized to frictionally fit within the ends of channels 44 to connect housing 12 and 14 together. FIG. 4 shows extension 16 frictionally inserted within channel 44 of lower trackway 42 with a section of shading member 20 positioned within an extension channel 48 formed within each extension 16,18.

Figure 5:
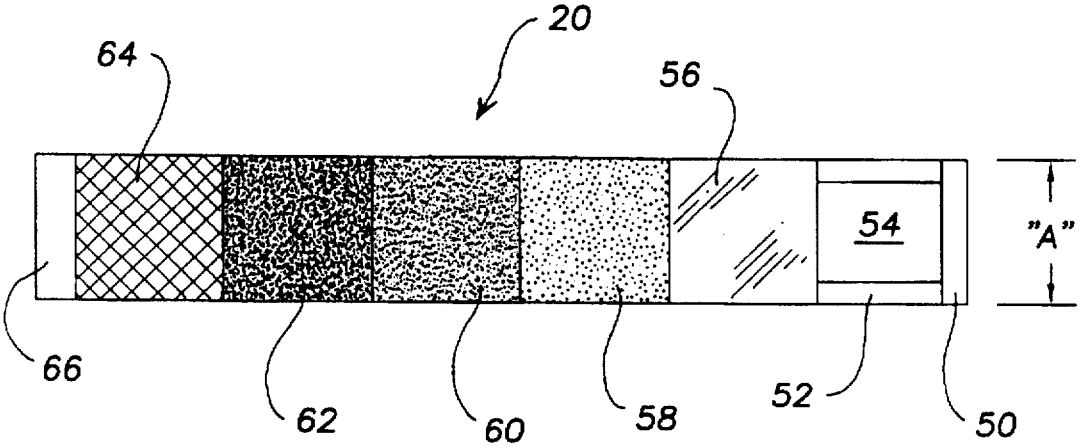
FIG. 5 is a plan view of an exemplary flexible shading member showing, from right to left, the first reel attachment section, the cut-out section element, the transparent element, the light tinted element, the medium tinted element, the dark tinted element, the black-out element with a reflective coating provided on the exteriorly facing surface thereof, and the second reel attachment section.

FIG. 5 shows the exemplary flexible shading member 20 in isolation. Shading member 20 is a length of Mylar film. A first end section 50 is provided for securement to one of the reel shafts 28. A second section 52 has a cut-out portion 54 provided therein to allow the user to move items through the window opening in use. A third section 56 is transparent and clear. A fourth section 58 has a tint factor of about twenty-five percent. A fifth section 60 has a tint factor of about sixty percent. A sixth section 62 has a tint factor of about 100 percent. A seventh section 64 has a fiberglass cloth coating covered with a plastic coated reflective foil. An eighth section 66 is provided for attachment to the other reel shaft 28. Sections two through seven 52,56,58,60,62,64 are each of a width "a" and a length greater than the combined lengths of extension 16, and twice the length of trackway 40 to ensure that each section 52,56,58,60,62,64 covers sufficient area.

Figure 6:
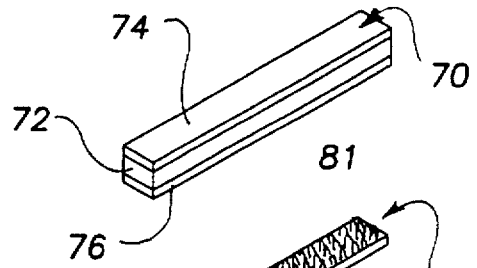
FIG. 6 is a plan view of a section of the adhesive backed foam stripping supplied with the window shade system to fill the gap between the adjustment segments and the window casing.

FIG. 6 shows a section of an adhesive backed foam stripping 70 that is supplied with this embodiment of window shade system 10. Foam stripping 70 is supplied to fill the gap existing between extensions 16,18 and the window casing. Each section of foam stripping 70 includes a foam layer 72 coated with an adhesive on two opposed sides thereof and then supplied with peel of covers 74,76.

Figure 6A:
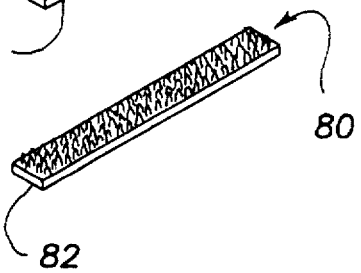
FIG. 6A is a plan view of a section of the adhesive backed hook and pile fastener stripping supplied with the window shade system to place onto the window casing to hold the reel housing in place.

FIG. 6A shows a section of an adhesive backed hook and pile fastener stripping 80 supplied with the exemplary window shade system 10. Fastener stripping 80 includes hook and pile material 81 complementary to that of sections 38. The adhesive covered back surface of fastener stripping 80 is also covered with a peel off cover 82. In use, peel off cover 82 is removed and the adhesive surface contacted against the window casing of the window to which window system 10 is to be utilized. A stripping section 80 is provided for each of sections 38.

Figure 7:
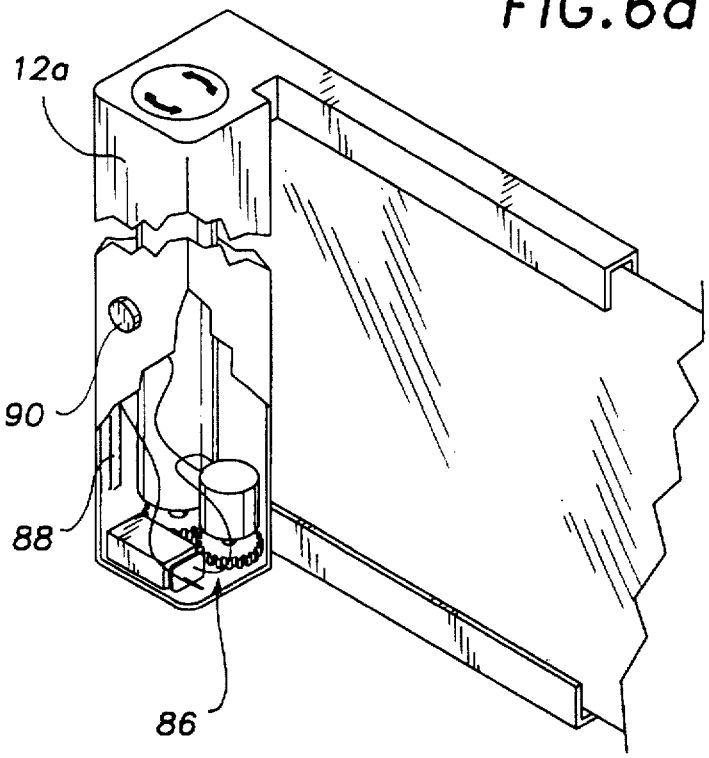
FIG. 7 is a partial cutaway view of a second exemplary reel housing showing a motor drive assembly and a light sensing control circuit having a light detection element.

FIG. 7 is a partial cutaway view of a second exemplary reel housing **12*a* showing a motor drive assembly 86 and a light sensing control circuit 88. In this embodiment, control circuit 88 includes a photocell 90 for detecting the light level within the room and comparator circuitry for determining the correct operating direction for motor drive assembly 86. Motor drive assembly 86** operates until the light level within the room equals the preset value used in the comparator circuit.

Figure 8:
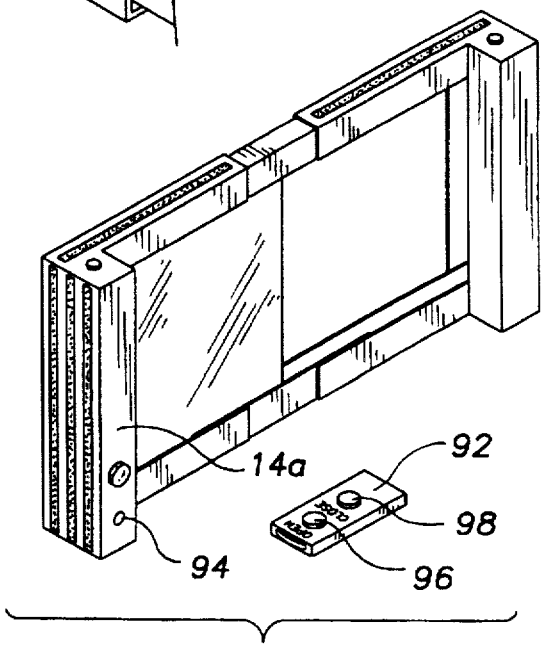
FIG. 8 is a perspective view of a third embodiment of the reel housing having a remote control mechanism including a hand held remote transmitter circuit and a reel housing mounted receiving circuit.

FIG. 8 illustrates a third exemplary embodiment of housing **14*a* having a remote control mechanism including a hand held transmitter 92 and a receiving circuit 94. This embodiment includes a motor drive assembly 86 controlled by receiving circuit 94. Transmitter 92 and receiving circuit 94 are conventional remote control circuits. Directional buttons 96,98 are provided on transmitter 92 to allow the user to transmit the desired operating direction to receiving circuit 94**.

Figure 9:
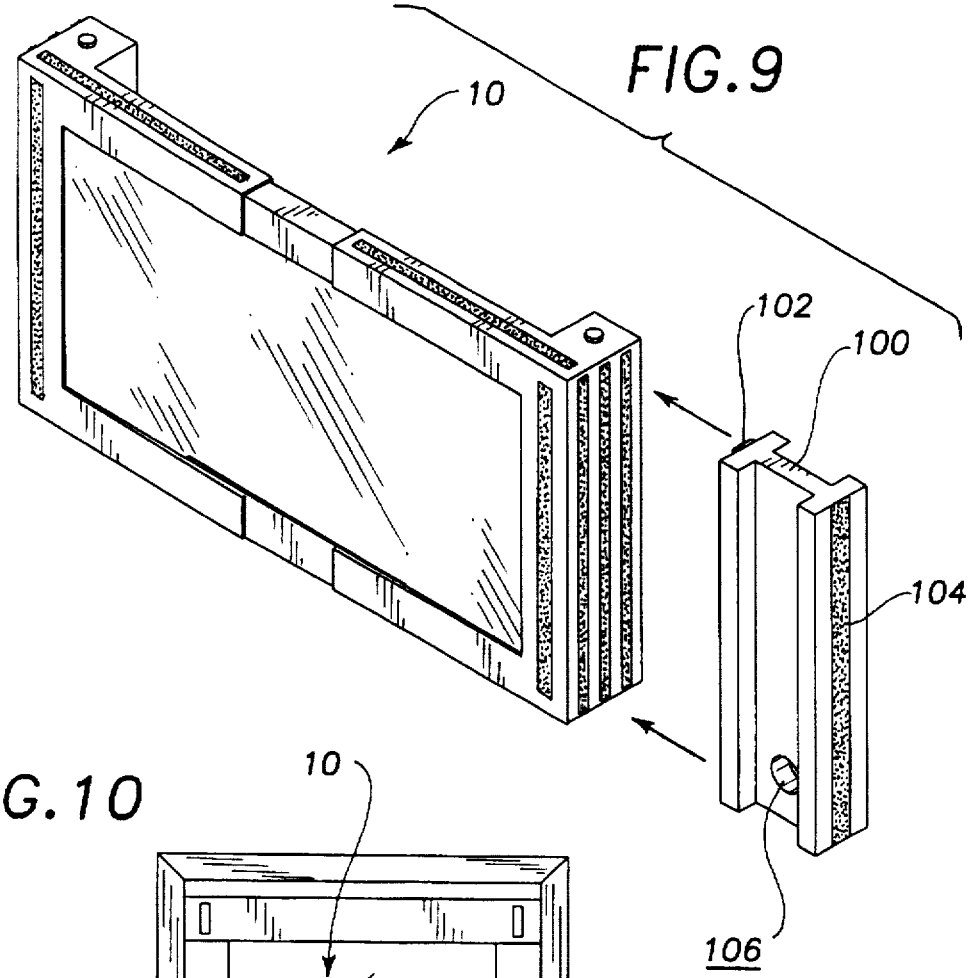
FIG. 9 is a perspective view of an extension element that can be provided with the system if desired. The extension element has an aperture formed therethrough for passing window mechanisms such as crank handles for jalousie type windows.

FIG. 9 shows an optional extension element 100 that can be provided with window shade system 10 if desired. Extension element 100 includes a first fastener strip 102 having the same hook and pile material as fastener stripping 80 and a second fastener strip 104 having the same hook and pile fastener material as sections 38. An opening 106 is provided for allowing passage of a crank handle from a jalousie-type window or other window construction having an operating crank.

Figure 10:
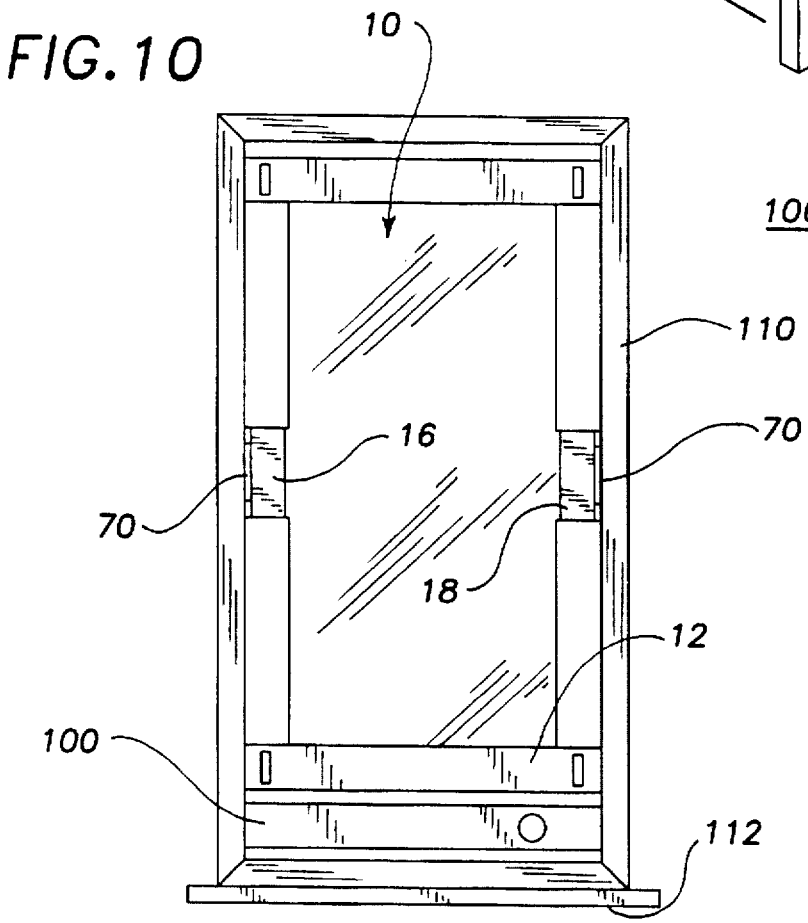
FIG. 10 is a plan view showing the window system of the present invention installed in a typical application including the extension element in a representative window casing.

FIG. 10 shows first exemplary window shade system 10 installed in a conventional representative window casing 110 with foam sections 70 inserted into the gap between extensions 16,18 and window casing 110. An extension element 100 is also shown positioned between housing 12 and window ledge 112.

It can be seen from the preceding description that a window shade system has been provided that includes a shading member having multiple, sequentially connected window shading elements and that one of those shading elements is a cut-out portion that provides no shading element or barrier between the room and the window when desired.

It is noted that the embodiment of the window shade system with multiple, sequentially connected window shading elements described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A window shade system comprising:

a flexible shading member having multiple, sequentially connected shading elements, at least one of said shading elements having a tint factor of between five and fifty percent inclusive, at least one of said shading elements having a tint factor between fifty-one and ninety-five percent inclusive; and first and second reel assemblies, each reel assembly being attachable to a structure adjacent a window, said first reel assembly having a first rotatable reel shaft secured to a first end of said shading member, said second reel assembly having a second rotatable reel shaft secured to a second end of said shading member, said first and second reel assemblies working in a complimentary fashion such that when one reel assembly is rotating in a take-off direction said other reel assembly is rotating in a take-up direction;

said first reel assembly being positioned within a first reel compartment formed within a first reel housing;

said second reel assembly being positioned within a second reel compartment formed within a second reel housing;

said first reel housing including a first pair of spaced trackways that extend from said first reel housing adjacent to a first opening formed through an outer wall of said first reel housing and in connection with said first reel compartment formed therein, said first pair of spaced trackways each having a guide channel formed therein for receiving and guiding an edge section of said shading member into and out of said first opening;

said second reel housing including a second pair of spaced trackways that extend from said second reel housing adjacent to a second opening formed through an outer wall of said second reel housing and in connection with said second reel compartment formed therein, said second pair of spaced trackways each having a guide channel formed therein for receiving and guiding an edge section of said shading member into and out of said second opening;

said first pair of spaced trackways being connectable to said second pair of spaced trackways; said window shade system further including:

first and second adjustment segments that are each connectable between a trackway of said first reel housings and a trackway of said second reel housing.

2. The window shade system of claim 1, wherein:

said flexible shading member includes a cut-out section positionable by rotation of said first and second reel shafts.

3. The window shade system of claim 2, wherein:

said flexible shading member includes at least one black-out shading element having an opaque layer having a tint factor of substantially one-hundred percent.

4. The window shade system of claim 1 wherein:

said first reel shaft has a coaxially mounted first thumb wheel at one end thereof;

said first reel housing includes a first thumb wheel opening through which a portion of said first thumb wheel extends;

said second reel shaft has a coaxially mounted second thumb wheel at one end thereof; and said second reel housing includes a second thumb wheel opening through which a portion of said second thumb wheel extends.

5. A window shade system comprising:

a flexible shading member having multiple, sequentially connected shading elements, at least one of said shading elements having a tint factor of between five and fifty percent inclusive, at least one of said shading elements having a tint factor between fifty-one and ninety-five percent inclusive; and first and second reel assemblies, each reel assembly being attachable to a structure adjacent a window, said first reel assembly having a first rotatable reel shaft secured to a first end of said shading member, said second reel assembly having a second rotatable reel shaft secured to a second end of said shading member, said first and second reel assemblies working in a complimentary fashion such that when one reel assembly is rotating in a take-off direction said other reel assembly is rotating in a take-up direction;

said first reel assembly being positioned within a first reel compartment formed within a first reel housing;

said second reel assembly being positioned within a second reel compartment formed within a second reel housing;

said first reel housing including a first pair of spaced trackways that extend from said first reel housing adjacent to a first opening formed through an outer wall of said first reel housing and in connection with said first reel compartment formed therein, said first pair of spaced trackways each having a guide channel formed therein for receiving and guiding an edge section of said shading member into and out of said first opening;

said second reel housing including a second pair of spaced trackways that extend from said second reel housing adjacent to a second opening formed through an outer wall of said second reel housing and in connection with said second reel compartment formed therein, said second pair of spaced trackways each having a guide channel formed therein for receiving and guiding an edge section of said shading member into and out of said second opening;

said first pair of spaced trackways being connectable to said second pair of spaced trackways; said window shade system further including:

said first reel shaft having a coaxially mounted first thumb wheel at one end thereof;

said first reel housing including a first thumb wheel opening through which a portion of said first thumb wheel extends;

said second reel shaft having a coaxially mounted second thumb wheel at one end thereof; and said second reel housing including a second thumb wheel opening through which a portion of said second thumb wheel extends.

6. The window shade system of claim 5, wherein:

said flexible shading member includes a cut-out section positionable by rotation of said first and second reel shafts.

7. The window shade system of claim 5, wherein:

said flexible shading member includes at least one black-out shading element having an opaque layer having a tint factor of substantially one-hundred percent.

* * * * *